US009765736B2

(12) United States Patent
Koppel et al.

(10) Patent No.: US 9,765,736 B2
(45) Date of Patent: Sep. 19, 2017

(54) FUEL SUPPLY SYSTEM

(71) Applicants: Arthur Koppel, Augsburg (DE); Andreas Franke, Augsburg (DE)

(72) Inventors: Arthur Koppel, Augsburg (DE); Andreas Franke, Augsburg (DE)

(73) Assignee: MAN Diesel & Turbo SE, Augsburg (DE)

( * ) Notice: Subject to any disclaimer, the term of this patent is extended or adjusted under 35 U.S.C. 154(b) by 549 days.

(21) Appl. No.: 14/132,656

(22) Filed: Dec. 18, 2013

(65) Prior Publication Data

US 2014/0174407 A1 Jun. 26, 2014

(30) Foreign Application Priority Data

Dec. 20, 2012 (DE) ..... 10 2012 025 022

(51) Int. Cl.
*F02M 37/22* (2006.01)
*F02D 19/06* (2006.01)
*F02M 37/00* (2006.01)

(52) U.S. Cl.
CPC ..... *F02M 37/22* (2013.01); *F02D 19/06* (2013.01); *F02M 37/007* (2013.01); *F02M 37/0052* (2013.01)

(58) Field of Classification Search
CPC ... Y02T 10/36; F02D 19/081; F02D 19/0647; F02D 19/0689; F02D 19/0692; F02D 19/0665; F02D 19/0671; F02D 19/061; F02D 19/0628; F02D 19/0655; F02D 19/0694; F02D 19/08; F02D 19/0644; F02D 19/0684; F02D 19/0613; F02D 19/0615
USPC ..... 123/575, 576, 577, 578
See application file for complete search history.

(56) References Cited

U.S. PATENT DOCUMENTS 4,809,666 A * 3/1989 Baltz ..... F02M 37/20 123/510
5,816,212 A * 10/1998 Lindquist ..... F01M 1/02 123/196 A
5,832,903 A * 11/1998 White ..... F02M 31/20 123/514

(Continued)

FOREIGN PATENT DOCUMENTS

CN 101658741 3/2010
CN 201424989 3/2010

(Continued)

OTHER PUBLICATIONS

Search Report dated Aug. 16, 2016 which issued in the corresponding Chinese Patent Application No. 201310708354.7.

*Primary Examiner* — Sizo Vilakazi
(74) *Attorney, Agent, or Firm* — Cozen O'Connor

(57) ABSTRACT

A fuel supply system includes a feeder fuel circuit configured to: (i) convey a first fuel in a direction of a mixing tank via a first pump device proceeding from a first fuel tank for a first fuel type; or (ii) convey a second fuel in the direction of the mixing tank via the first pump device proceeding from a second fuel tank for a second fuel type; and a booster fuel circuit configured to convey fuel via a second pump device proceeding from the mixing tank in a direction of at least one marine diesel engine, the booster fuel circuit having an automatic fine filter positioned upstream of or downstream of the at least one marine diesel engine and in the booster fuel circuit, respectively.

9 Claims, 1 Drawing Sheet

(56) References Cited

U.S. PATENT DOCUMENTS

| | | | | |
|---|---|---|---|---|
| 6,273,031 | B1 * | 8/2001 | Verdegan | F01M 11/0458 123/1 A |
| 6,319,417 | B1 * | 11/2001 | Rodibaugh | B01D 29/336 184/6.24 |
| 8,517,182 | B2 | 8/2013 | Zheng et al. | |
| 2014/0174407 | A1 * | 6/2014 | Koppel | F02M 37/22 123/495 |

FOREIGN PATENT DOCUMENTS

| | | | | |
|---|---|---|---|---|
| CN | 202273792 | | 6/2012 | |
| DE | 30 20 501 | A1 | 12/1981 | |
| DE | 3020501 | * | 12/1981 | |
| DE | 198 28 772 | A1 | 12/1999 | |
| DE | 19828772 | A1 * | 12/1999 | F02M 31/02 |
| JP | 58-112115 | | 8/1983 | |
| WO | WO 2011/088830 | | 7/2011 | |

* cited by examiner

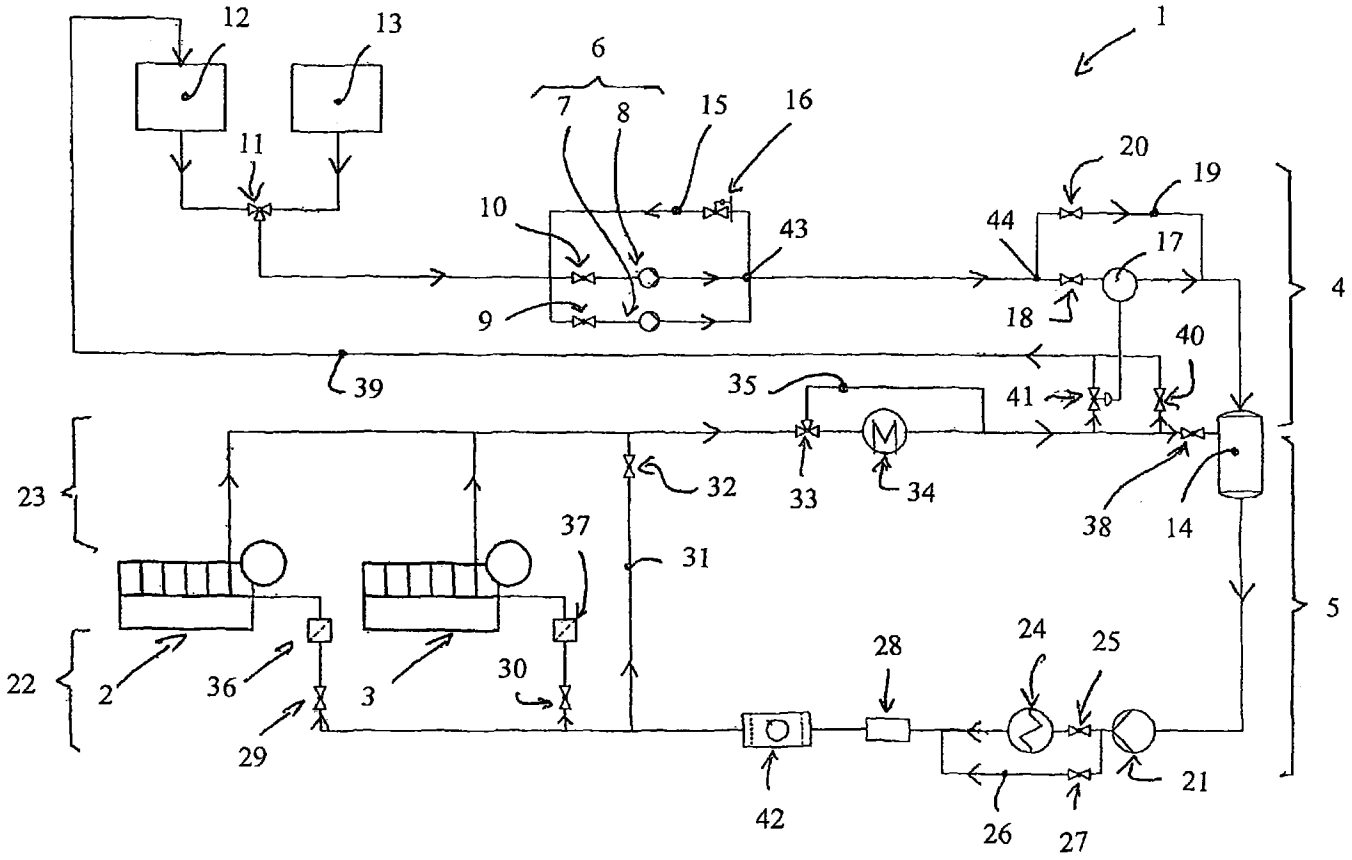
1
2
3
4
5
6
7
8
9
10
11
12
13
14
15
16
17
18
19
20
21
22
23
24
25
26
27
28
29
30
31
32
33
34
35
36
37
38
39
40
41
42
43
44

FUEL SUPPLY SYSTEM

BACKGROUND OF THE INVENTION

1. Field of the Invention

The invention is directed to a fuel supply system for at least one marine diesel engine.

2. Description of the Related Art

It is known that marine diesel engines can be operated with different types of fuel. For example, it is possible to operate marine diesel engines with heavy oil fuels on the one hand and with distillate fuels on the other hand. Heavy oil fuels are economical but cause relatively high fuel emissions due to their high sulfur content. Distillate fuels cause lower exhaust gas emissions but are expensive. Marine diesel engines are operated with heavy oil fuels on the open sea for reasons of economy. On the other hand, when a ship is to be operated in proximity to a coast, in a so-called SECA (Sulfur Emission Control Area) zone, operation of the marine diesel engine must be switched over from a heavy oil fuel to a distillate fuel for reasons pertaining to emissions. A ship may only enter a SECA zone when a marine diesel engine meets the emission requirements of this SECA zone with respect to harmful emissions by burning a distillate fuel.

Conventionally, a fuel supply system for a marine diesel engine by means of which the marine diesel engine can be supplied either with a heavy oil fuel or with a distillate fuel has what are known as a feeder fuel circuit and a booster fuel circuit.

Either the first fuel or the second fuel can be conveyed via the feeder fuel circuit in the direction of a mixing tank by a first pump device. By a second pump device of the booster fuel circuit, fuel can be conveyed from the mixing tank in the direction of the marine diesel engine or every marine diesel engine. The first pump device of the feeder fuel circuit sucks in the respective fuel with a first conveyed volume flow. A first partial conveyed volume flow of this first conveyed volume flow is conveyed in direction of the mixing tank, and a second partial conveyed volume flow of this first conveyed volume flow is circulated in the feeder fuel circuit. The second pump device of the booster fuel circuit sucks the fuel out of the mixing tank with a second conveyed volume flow, which is appreciably larger than the first conveyed volume flow. Thus, more fuel is conveyed via the marine diesel engine or every marine diesel engine than is actually consumed so as to make surplus fuel available particularly for cooling and lubrication. Fuel that is not consumed by the internal combustion engine(s) is returned to the mixing tank via a feed flow of the booster fuel circuit.

It is known to arrange an individual coarse filter, respectively, in the booster fuel circuit upstream of the marine diesel engine or every marine diesel engine in order to filter coarse impurities from the fuel conveyed in direction of the respective marine diesel engine by the booster fuel circuit. Filters of this kind are also known as control filters. Further, it is known from practice to provide a fine filter in the feeder fuel circuit to filter fine impurities from the fuel conveyed into the mixing tank by the feeder fuel circuit.

SUMMARY OF THE INVENTION

Against this background, the present invention has the object of providing a novel fuel supply system for at least one marine diesel engine.

This object is met by a fuel supply system in which a booster fuel circuit comprises an automatic fine filter positioned upstream or downstream of the marine diesel engine or every marine diesel engine in the booster fuel circuit. In this way it is possible to filter out fine impurities from the fuel directly upstream of the marine diesel engine or of every marine diesel engine. In this way, the lifetime of structural component parts of the injection system of the marine diesel engine or of every marine diesel engine can be prolonged.

According to an aspect of the present invention, the automatic fine filter of the booster fuel circuit can preferably be cleaned automatically by backwashing without interrupting operation. This allows the marine diesel engine to operate without interruption.

According to an advantageous further aspect of the invention, all of the marine diesel engines share a common automatic fine filter, an individual coarse filter is preferably provided for every marine diesel engine, and the common automatic fine filter is arranged upstream of the coarse filter. This configuration is simple and functions in a reliable manner.

Preferred further developments of the invention are indicated in the following description.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Embodiment examples of the invention are described more fully with reference to the drawing without the invention being limited to these embodiment examples.

In the drawing:

FIG. 1 is a schematic diagram of a fuel supply system according to the invention for at least one marine diesel engine.

DETAILED DESCRIPTION OF THE PRESENTLY PREFERRED EMBODIMENTS

The present invention is directed to a fuel supply system for at least one marine diesel engine and to a method for operating a fuel supply system of this type.

FIG. 1 is a schematic diagram showing a fuel supply system 1 which serves in the illustrated exemplary embodiment to supply fuel to two marine diesel engines 2 and 3. In contrast to the illustrated exemplary embodiment, the fuel supply system 1 can also supply fuel to only one marine diesel engine, or to more than two marine diesel engines. The fuel supply system 1 comprises a feeder fuel circuit 4 and a booster fuel circuit 5.

The feeder fuel circuit 4 has a first pump device 6 which is formed in the illustrated embodiment by two fuel pumps 7 and 8 in parallel. A stop valve 9 and 10, respectively, is arranged upstream of each of the two pumps 7 and 8 in the illustrated embodiment. Using the first pump device 6 of the feeder fuel circuit 4, and depending on the switching position of a valve 11, either a first fuel, namely, a heavy oil fuel in the illustrated embodiment, can be sucked in proceeding from a first fuel tank 12, or a second fuel, namely a distillate fuel in the illustrated embodiment example, can be sucked in proceeding from a second fuel tank 13. The fuel sucked in by the first pump device 6 of the feeder fuel circuit 4 can be conveyed in the direction of a mixing tank 14.

In a normal operating mode of the fuel supply system 1, the first pump device 6 of the feeder fuel circuit 4 sucks the corresponding fuel out of one of the two fuel tanks 12 or 13 with a defined first conveyed volume flow. A first partial conveyed volume flow of the first conveyed volume flow can be conveyed in direction of the mixing tank 14, and a second partial conveyed volume flow of this first conveyed volume flow is circulated in the feeder fuel circuit 4 by a circulating line 15 in which a pressure limiting valve 16 is integrated.

When the marine diesel engines 2 and 3 operate at full load, a total of one hundred percent of the fuel is consumed, the first conveyed volume flow sucked out of one of the two fuel tanks 12 or 13 by the pump device 6 typically amounts to 160% of this fuel consumption, where the first partial conveyed volume flow conveyed in direction of the mixing tank 14 is 100% and the second partial conveyed volume flow conducted via the circulating line 15 is 60%.

According to FIG. 1, the first partial conveyed volume flow of the first conveyed volume flow conveyed via the first pump device 6 of the feeder fuel circuit 4 in direction of the mixing tank 14 can be guided via a flow measuring device 17, namely, when a valve 18 arranged upstream of the flow measuring device 17 is opened. Alternatively, it is possible, for example, when the flow measuring device 17 is defective, to conduct the first partial conveyed volume flow of the first conveyed volume flow past the flow measuring device 17 via a bypass line 19 when the valve 18 is closed and a valve 20 integrated in the bypass line 19 is opened.

It should be noted here that the second partial conveyed volume flow of the first conveyed volume flow, which is circulated in the feeder fuel circuit 4 via the circulating line 15, is adjusted by the pressure limiting valve 16 in such a way that there is a constant pressure level for the first partial conveyed volume flow conveyed to the mixing tank 14. This pressure level can be 7 bar, for example.

When heavy oil fuel, as a first fuel type, is conveyed in direction of the mixing tank 14 via the feeder fuel circuit 4 proceeding from the first fuel tank 12, this heavy oil fuel is preheated in the first fuel tank 12. The temperature of the heavy oil fuel in the first partial conveyed volume flow conveyed to the mixing tank 14 is typically about 90° C.

The booster circuit 5 has a second pump device 21 by which fuel can be sucked out of the mixing tank 14 and conveyed in direction of the marine diesel engine or every marine diesel engine 2, 3. The portion of the booster fuel circuit 5 by which fuel can be conveyed to the marine diesel engine or every marine diesel engine 2, 3 proceeding from the mixing tank 14 is also known as the feed flow 22 of the booster fuel circuit 5.

Fuel that is conveyed via the feed flow 22 in the direction of the marine diesel engine or every marine diesel engine 2, 3, but which is not burned in the marine diesel engine or every marine diesel engine 2, 3, can be returned in direction of the mixing tank 14 via a return flow 23 of the booster fuel circuit 5.

As can be gathered from FIG. 1, the fuel sucked in from the mixing tank 14 via the second pump device 21 of the booster fuel circuit 5 can be conveyed via a preheating device 24, namely when the marine diesel engine or every marine diesel engine 2, 3 is operated with heavy oil fuel.

When the marine diesel engine or every marine diesel engine 2, 3 is operated with distillate fuel, a valve 25 upstream of the preheating device 24 is closed so that the distillate fuel is guided via a bypass line 26 when valve 27 is open. Downstream of the preheating device 24, a viscosity measuring device 28 is integrated in the feed flow 22 of the booster fuel circuit 5 and when heavy oil fuel is guided via the preheating device 24 this viscosity measuring device 28 adjusts the operation of the preheating device 24 to influence the viscosity of the heavy oil fuel via the preheating device 24.

Heavy oil fuel is typically heated by the preheating device 24 in order to adjust a viscosity of 12-14 cSt (Stoke). The pressure level in the booster fuel circuit 5 downstream of the second pump device 21 can be 12 bar, for example.

As was already stated, the second pump device 21 of the booster fuel circuit 5 sucks fuel out of the mixing tank 14 and conveys it in direction of the marine diesel engine or every marine diesel engine 2, 3, namely depending on the open position of valves 29, 30 upstream of the marine diesel engines 2, 3. The second pump device 21 of the booster fuel circuit 5 sucks fuel out of the mixing tank 14 with a second conveyed volume flow, which is appreciably higher than the first conveyed volume flow of the feeder fuel circuit 4.

Accordingly, it is provided in a specific exemplary embodiment that when the first conveyed volume flow of the feeder fuel circuit 4 is 160%, the second conveyed volume flow of the booster fuel circuit 5 is 300%, and when both valves 29, 30 are open, 150% partial conveyed volume flow is guided respectively via every marine diesel engine 2, 3.

However, under full load the two marine diesel engines 2, 3 together can burn a maximum of 100% of the fuel, i.e., each marine diesel engine 2, 3 by itself can burn a maximum of 50% of the fuel. It follows that more fuel is conveyed via the two marine diesel engines 2, 3 than can be burned therein. This surplus fuel is used for cooling and lubrication and can be returned in direction of the mixing tank 14 via the return flow 23.

When one of the two valves 29, 30 is closed, i.e., when one of the two marine diesel engines 2, 3 is decoupled from the feed flow 22 of the booster fuel circuit 5, the fuel that cannot be conveyed via the decoupled marine diesel engine 2, 3 can bypass the other marine diesel engine 3, 2 via the bypass line 31 when a bypass valve 32 integrated in this bypass line 31 is opened.

Fuel which can be conveyed back in the direction of the mixing tank 14 via the return flow 23 of the booster fuel circuit 5 can be guided either via a cooling device 34 or via a bypass line 35 depending on the position of a valve 33 integrated in the return flow 23.

When a heavy oil fuel is burned as fuel in the marine diesel engine or in every marine diesel engine 2, 3, surplus heavy oil fuel that is not burned bypasses the cooling device 34 via the bypass line 35. When a distillate fuel is burned as fuel in the marine diesel engine or every marine diesel engine 2, 3, surplus distillate fuel that is not burned can be guided via the cooling device 34 depending on the temperature of the distillate fuel.

The first pump device 6 of the feeder fuel circuit 4 is preferably designed such that in a switchover operating mode in which there is a changeover from the first fuel, i.e., the heavy oil fuel, to the second fuel, i.e., the distillate fuel, for operation of the marine diesel engine or every marine diesel engine 2, 3, the first pump device 6 sucks the second fuel from the second fuel tank 13 with a third conveyed volume flow rather than with the first conveyed volume flow, this third conveyed volume flow being greater than the first conveyed volume flow.

According to an advantageous embodiment, the first pump device 6 of the feeder fuel circuit 4 is configured in such a way that in the switchover operating mode it sucks the second fuel out of the second fuel tank 13 with a third conveyed volume flow such that the first partial conveyed volume flow of the third conveyed volume flow conveyed in direction of the mixing tank 14 corresponds to the second conveyed volume flow of the booster fuel circuit 5, i.e., to the conveyed volume flow of the second pump device 21 of the booster fuel circuit.

In a specific embodiment example, it is provided that in the switchover operating mode the first partial conveyed volume flow of the third conveyed volume flow, which is conveyed from the pump device 6 of the feeder fuel circuit 4 in direction of the mixing tank 14, amounts to 300%, i.e., corresponds to the second conveyed volume flow of the booster fuel circuit 5.

In this respect, it can be provided that 160% of the second fuel is sucked out of the second fuel tank 13 via each of the two pumps 7, 8 of the pump device 6 of the feeder fuel circuit 4 and 300% is fed to the mixing tank 14, while the remaining 20% is circulated via the circulating line 15 in the feeder fuel circuit 4.

A first stop valve 38 is connected in the return flow 23 of the booster fuel circuit 5 upstream of the mixing tank 14, which first stop valve 38 is open in normal operating mode and closed in switchover operating mode. Upstream of this first stop valve 38, a fuel discharge line 39 opening into the first fuel tank 12 for the heavy oil fuel in the illustrated embodiment branches off from the return flow 23 of the booster fuel circuit 5. A second stop valve 40 which is closed in the normal operating mode and is open in the switchover operating mode connects to this fuel discharge line 39.

Accordingly, when switching the fuel supply from a heavy oil fuel to a distillate fuel it is possible to increase the pump rate of the first pump device 6 of the feeder fuel circuit 4 so that the heavy oil fuel located in the booster fuel circuit 5 can be removed from the latter quickly and exchanged quickly for distillate fuel. After increasing the pump rate of the first pump device 6 of the feeder fuel circuit 4, the second stop valve 40 is first opened and the first stop valve 38 is then closed.

After changing to the switchover operating mode, the first pump device 6 of the feeder fuel circuit 4 is preferably operated for a defined time period or for a defined volume flow at the increased pump rate so that the switchover operating mode then remains active for a defined time period or for a defined volume flow.

At the expiration of this time period or after achieving this volume flow, operation is switched back to the normal operating mode. For this purpose, the two stop valves 38 and 40 are controlled first, i.e., the first stop valve 38 is opened and the second stop valve 40 is closed, so that the pump rate of the first pump device 6 of the feeder fuel circuit 4 is then reduced, i.e., decreased from the third conveyed volume flow to the first conveyed volume flow which is pumped out of the respective fuel tank 12, 13 by the first pump device 6 in normal operating mode.

Accordingly, when changing from a heavy oil fuel supply to a distillate fuel supply the heavy oil fuel located in the booster fuel circuit 5 can quickly be removed from the latter and quickly exchanged for distillate fuel so that within a short time of switching the fuel supply to distillate fuel supply a ship can enter a SECA zone.

According to FIG. 1, a control valve 41 is connected in parallel with the second stop valve 40. This control valve 41 is controllable as a function of a measurement signal of the flow measuring device 17. By opening this control valve 41 in a corresponding manner, it is possible with this control valve 41 to convey fuel from the return flow 23 in the direction of the fuel discharge line 39 when the marine diesel engine or every marine diesel engine 2, 3 burns relatively little fuel and when relatively little fuel is therefore conveyed back into the mixing tank 14 from the feeder fuel circuit 4.

In this way, a constant consumption can be adjusted in the booster fuel circuit 5 regardless of the actual fuel consumption of the marine diesel engine or of every marine diesel engine 2, 3, so that a constant amount of fuel is guided back to the mixing tank 14 via the feeder fuel circuit 4.

This is particularly advantageous when the temperature in the booster fuel circuit 5 of the fuel supply system 1 is to be reduced when changing from a normal operating mode to a switchover operating mode before increasing the pump rate of the first pump device 6 of the feeder fuel circuit 4. As was explained above, the temperature level in the booster fuel circuit 5 during heavy oil fuel operation is approximately 140° C. Before changing to distillate fuel operation, however, the temperature level in the booster fuel circuit 5 should be lowered to approximately 45° C. A period of time required for a cooling process of this kind depends in practice on the actual fuel consumption of the marine diesel engine(s) 2, 3. By controlling the control valve 41 as a function of the measurement signal of the flow measuring device 17, the cooling process can be configured independent from the actual consumption of the marine diesel engine or of each marine diesel engine 2, 3. Accordingly, the time at which it is possible to switch to distillate fuel operation is also independent from the actual consumption of the marine diesel engine or every marine diesel engine 2, 3. By opening the control valve 41, a constantly high fuel consumption of the marine diesel engine or every marine diesel engine 2, 3 can be simulated in order to convey a constant volume into the mixing tank 14 via the pump device 6. Thus when the measurement signal of the flow measuring device 17 indicates a relatively low consumption of the marine diesel engine or every marine diesel engine 2, 3, the control valve 41 is opened further, whereas when the measurement signal of the flow measuring device 17 indicates a relatively high consumption of the marine diesel engine or of every marine diesel engine 2, 3, the control valve 41 is closed further.

According to FIG. 1, a coarse filter 36, 37 is arranged in front of each internal combustion engine 2, 3 downstream of the respective valve 29, 30 in order to filter coarse impurities out of the fuel conveyed in the booster fuel circuit 5 so as to protect the marine diesel engine or every marine diesel engine 2, 3 against damage. Each coarse filter 36, 37 of the booster fuel circuit 5 filters impurities out of the fuel conveyed from the booster fuel circuit 5 in the direction of the respective marine diesel engine 2, 3, which impurities are typically larger than 25 μm.

According to the invention, the booster fuel circuit 5 comprises an automatic fine filter 42 positioned upstream of the marine diesel engine or every marine diesel engine 2, 3. This makes it possible to filter fine impurities out of the fuel directly upstream of the marine diesel engine or of every marine diesel engine 2, 3. In particular, impurities borne by structural component parts of the injection system are filtered out of the fuel. The arrangement of the automatic fine filter 42 in the booster fuel circuit 5 brings about a multipass effect. The lifetime of structural component parts of the injection system of the marine diesel engine or every marine diesel engine 2, 3 can be prolonged in this way. The automatic fine filter 42 preferably filters out impurities from the fuel conveyed from the booster fuel circuit 5 in the direction of the marine diesel engine or every marine diesel engine 2, 3 which are larger than 10 μm, particularly larger than 6 μm, preferably larger than 3 μm. The automatic fine filter 42 can be cleaned automatically without interrupting operation by backwashing. This allows the marine diesel engine 2, 3 to operate without interruption.

A common automatic fine filter 42 is preferably provided for all of the marine diesel engines 2, 3. The common automatic fine filter 42 of the booster fuel circuit 5 is arranged upstream of the coarse filters 36, 37 of the booster fuel circuit 5 which are provided individually for the internal combustion engines. This configuration is simple and functions in a reliable manner.

It is possible to provide an additional automatic fine filter, not shown in FIG. 1, in the feeder fuel circuit 4, i.e., particularly downstream of a branch line 43 of the circulating line 15 and upstream of a branch line 44 of the bypass line 19.

When an automatic fine filter is provided in the feeder fuel circuit 4 and booster fuel circuit 5, respectively, the automatic fine filter 42 of the booster fuel circuit 5 is preferably designed to filter smaller impurities than the automatic fine filter of the feeder fuel circuit 4. Accordingly, it can be provided that the automatic fine filter of the feeder fuel circuit 4 filters out impurities from the fuel which are larger than 10 μm, whereas automatic fine filter 42 of the booster fuel circuit 5 filters out impurities from the fuel which are larger than 6 μm or larger than 3 μm.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A fuel supply system (1) comprising:

a feeder fuel circuit (4) configured to, using a first valve (11), select between:

(i) conveyance of a first fuel, from a first fuel tank (12) for a first fuel type, in a direction of a mixing tank (14) via a first pump device (6); and (ii) conveyance of a second fuel, from a second fuel tank (13) for a second fuel type, in the direction of the mixing tank (14) via the first pump device (6), wherein the first pump device (6) is arranged downstream of the first valve (11) and the first and second fuel tanks (12, 13) and upstream of the mixing tank (14), the first pump device comprising plural pumps (7, 8) arranged in parallel; and a booster fuel circuit (5) configured to convey fuel via a second pump device (21) proceeding from the mixing tank (14) in a direction of one or more marine diesel engines (2, 3), the booster fuel circuit (5) having an automatic fine filter (42) positioned upstream of the one or more marine diesel engines and in the booster fuel circuit, the automatic fine filter (42) being shared by the one or more marine diesel engines, the second pump device (21) being arranged downstream of the mixing tank (14).

2. The fuel supply system according to claim 1, wherein the automatic fine filter (42) filters out impurities larger than 10 μm from the fuel conveyed from the booster fuel circuit (5) in the direction of the one or more marine diesel engines.

3. The fuel supply system according to claim 1, wherein the automatic fine filter (42) is configured to be cleanable automatically by backwashing without interrupting operation.

4. The fuel supply system according to claim 1, wherein one or more marine diesel engines comprise plural marine diesel engines and the automatic fine filter (42) is shared by all of the plural marine diesel engines (2, 3).

5. The fuel supply system according to claim 4, wherein an individual coarse filter (36, 37) is provided in the booster fuel circuit (5) for every marine diesel engine (2, 3), wherein the shared automatic fine filter (42) of the booster fuel circuit (5) is arranged upstream of the coarse filters (36, 37) of the booster fuel circuit (5).

6. The fuel supply system according to claim 5, wherein each coarse filter (36, 37) of the booster fuel circuit (5) filters out impurities larger than 25 μm from the fuel conveyed from the booster fuel circuit (5) in the direction of a respective one of the marine diesel engines (2, 3).

7. The fuel supply system according to claim 1, wherein the first fuel is a heavy oil fuel and the second fuel is a distillate fuel.

8. The fuel supply system according to claim 1, wherein the automatic fine filter (42) filters out impurities larger than 6 μm from the fuel conveyed from the booster fuel circuit (5) in the direction of the at least one marine diesel engine.

9. The fuel supply system according to claim 1, wherein the automatic fine filter (42) filters out impurities larger than 3 μm from the fuel conveyed from the booster fuel circuit (5) in the direction of the at least one marine diesel engine.

* * * * *